United States Patent [19]

Schäfer

[11] Patent Number: 4,832,209

[45] Date of Patent: May 23, 1989

[54] SHELF OF LAMINATED MATERIAL

[75] Inventor: Gerhard Schäfer, Neunkirchen-Salchendorf, Fed. Rep. of Germany

[73] Assignee: Fritz Schäfer Gesellschaft mit Beschrankter Haftung, Neunkirchen, Fed. Rep. of Germany

[21] Appl. No.: 133,523

[22] Filed: Dec. 16, 1987

[30] Foreign Application Priority Data

Dec. 18, 1986 [DE] Fed. Rep. of Germany ..... 3643280

[51] Int. Cl.[4] ..... A47F 5/00

[52] U.S. Cl. ..... 211/153; 211/135

[58] Field of Search ..... 211/153, 135; 428/124, 428/122, 126, 130; 312/257 M

[56] References Cited

U.S. PATENT DOCUMENTS

| | | | |
|---|---|---|---|
| 1,100,306 | 6/1914 | Hunt | 211/135 X |
| 2,180,131 | 11/1939 | Zinser | 211/135 X |
| 2,626,063 | 1/1953 | Echlin | 211/135 X |
| 2,685,372 | 8/1954 | Palaith | 211/135 X |
| 3,100,572 | 8/1963 | Gingher et al. | 211/153 |
| 4,535,898 | 8/1985 | Jones et al. | 211/153 |

FOREIGN PATENT DOCUMENTS

| | | |
|---|---|---|
| 0087696 | 9/1983 | European Pat. Off. . |
| 2298985 | 8/1976 | France . |
| 912661 | 12/1962 | United Kingdom . |

*Primary Examiner*—Reinaldo P. Machado
*Assistant Examiner*—Sarah A. Lechok Eley
*Attorney, Agent, or Firm*—Toren, McGeady & Associates

[57] ABSTRACT

A shelf of laminated material, particularly of sheet metal, includes downwardly bent edges at the sides thereof, especially at the longitudinal sides. The downwardly bent edges form stiffening portions which over the width thereof have cross-sectional profiles which are at least partially opened toward the center of the shelf. Additional sectional members of laminated material are provided which have a cross-sectional shape which fits at least in certain areas to the open cross-sectional profile of the bent edges of the shelf. The additional sectional members are attachable and fixable on or in the bent edges of the shelf and may be additionally connectible to the shelf.

13 Claims, 3 Drawing Sheets

SHELF OF LAMINATED MATERIAL

BACKGROUND OF THE INVENTION

1. Field of the Invention

The present invention relates to a shelf of laminated material, particularly of sheet metal. The shelf has downwardly bent edges at the sides thereof, particularly at the longitudinal sides. The downwardly bent edges form stiffening portions which over the width thereof have cross-sectional profiles which are at least partially open toward the center of the shelf.

2. Description of the Prior Art

Shelves of this type are already known and have been in practical use for a long time.

Depending upon the required stability and stiffness, these known shelves are made of sheet metal blanks of different thicknesses. In order to increase the stability of the shelves of this type, they have been provided with stiffening sections, particularly at the longitudinal sides of the shelves. These stiffening sections have a cross-sectional shape of a closed pipe, such as, a square pipe. These shelves additionally have an end flange provided outside of the pipe section at the underside of the shelf. This end flange is attached to the shelf at the underside thereof by means of, for example, spot welding.

In a shelf of the type descried above disclosed German Offenlegungsschrift No. 31 24 922, stiffening sections are provided which are formed by downwardly bent edges. The stiffening sections include two parallel pipe sections which are held spaced apart from each other by means of a downwardly open channel section. The spaced-apart walls of the pipe sections which face each other simultaneously form the webs of the channel section.

In another shelf of laminated material disclosed in German Offenlegungsschrift No. 34 41 500, the cross-section of the pipe forming the stiffening section has at least at its lower, inwardly facing longitudinal rim an outwardly facing sectional portion which is formed by a step-like bent edge.

In all of the prior art shelves discussed above, the shelf proper and the stiffening sections provided at the shelf are made of the same laminated material, particularly sheet metal. The selection of the thickness of the laminated material is in direct relation to the desired or required stability of the stiffening sections, so that the entire shelf has this material thickness. However, in most cases, it would be completely sufficient to use a shelf in which the shelf proper has a reduced thickness in order to save material.

It is, therefore, the primary object of the present invention to provide a shelf of laminated material of the type described above in which the construction of the shelf and especially the stability and load bearing capacity thereof can be adapted without problems to different requirements.

SUMMARY OF THE INVENTION

In accordance with the present invention, in the shelf of laminated material additional sectional members of laminated material are provided. The sectional members have a cross-sectional shape which fits at least in certain areas into the open cross-sectional profile of the bent edges of the shelf. The additional sectional members are attachable and fixable on and/or in the bent edges of the shelf and may be additionally connectible to the shelf proper.

In the shelf according to the present invention it is possible to use sectional members of laminated material as stiffening sections which can be adapted in the optimum manner with respect to load bearing capacity, stability and torsional stiffness in accordance with the purpose for which the shelf is to be used, while the shelf proper may not only have a completely different material thickness but may even be made of a completely different material.

In accordance with a feature of the present invention, the thickness of the laminated material of the sectional members may be different from the thickness of the laminated material of the shelf proper. Usually, the material of the sectional members will have the greater material thickness.

In accordance with another advantageous feature of the present invention, the sectional members of laminated material are made from sheet metal sections formed by bending. Of course, it would also be possible to use sectional members of laminated material which has been prefabricated, for example, by rolling or the extrusion method.

Moreover, it is within the scope of the present invention to provide the cross-sectional portions of the sectional members which engage the bent edges of the shelf with at least two wall portions which extend at an angle relative to each other and rest against the inner surfaces of the bent edges for a stable support and fixing of the sectional members.

In accordance with another feature of the present invention, the sectional members may be connected to the shelf by means of snap connections. These snap connections may be locking tongues and lugs formed in the sectional members and/or the shelf and by corresponding engagement openings.

In accordance another present invention, the sectional members may also be attached to the shelf in the region of the bent edges thereof by means of welding, particularly spot welding, or by riveting.

In accordance with yet another feature of the present invention, the sectional members are open or half-open sections which each have a plurality of parallel sectional steps, sectional creases and sectional channels or the like, wherein at least the two outermost longitudinal edges thereof can be used as support flanges and/or fastening flanges.

In accordance with a further development of the invention, a shelf is provided with several sectional members having identical shapes but different material thicknesses.

In accordance with another feature of the present invention, the shelves may have openings, particularly slots, near the sides of the shelves and the sectional members may have corresponding openings, wherein the openings of the shelf and the openings of the sectional members may be placed next to each other, so that the openings together form engagement means for support tongues of separating walls for shelf systems or the like.

In accordance with a method for manufacturing the shelf according to the present invention, stiffening portions are initially formed by downwardly bending the edges of a sheet metal blank at the longitudinal sides and/or transverse sides thereof, and subsequently engaging and/or connecting additional sectional members of laminated material to the stiffening portions for further increasing the stability of the shelf. The cross-sectional shape and/or material thickness of the sectional members of laminated material may be selected differently in accordance with the required and/or desired stability increase of the shelf.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
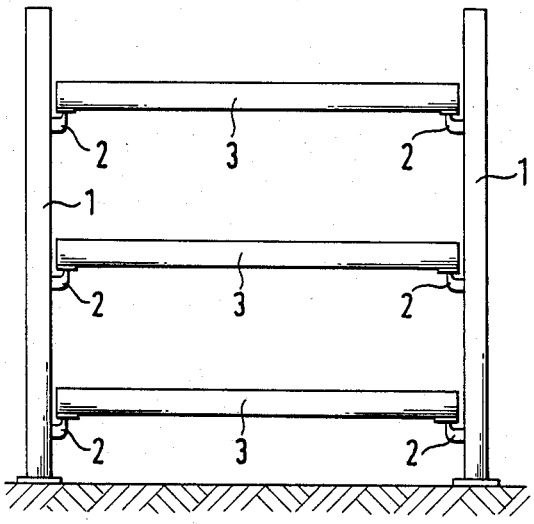
FIG. 1 is a schematic elevational view of a shelf system using shelves in accordance with the present invention.

The shelf system illustrated in FIG. 1 has at least four identical posts 1. The shelf system is provided with shelves 3. The posts 1 are provided at their inwardly facing sides with support elements and/or coupling elements 2 for the shelves 3. The elements 2 may be uniformly spaced-apart tongues which are punched out of the posts. However, it is also possible to provide rows of holes in the posts 1 for receiving angle pieces which serve to support the shelves 3.

Figure 2:
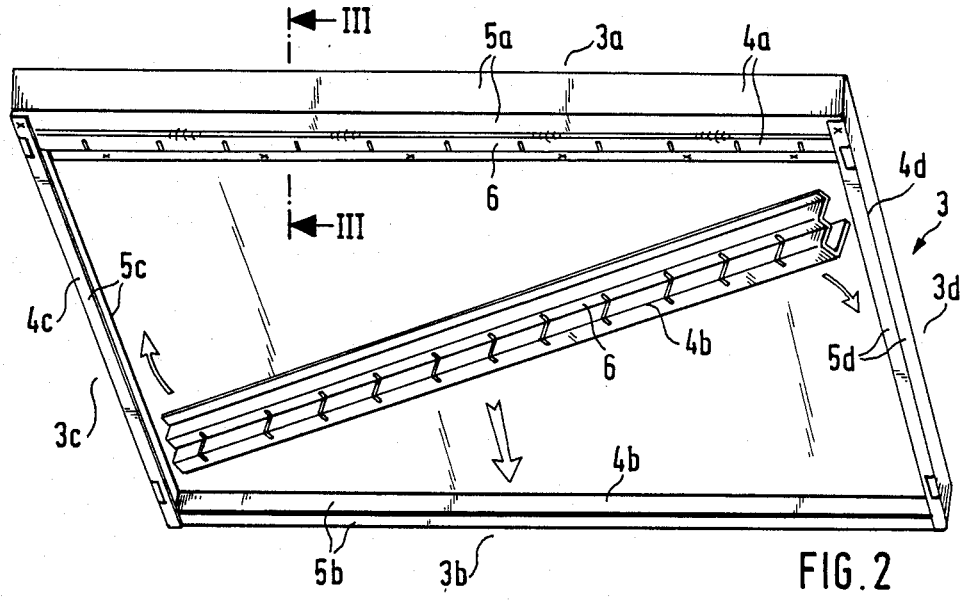
FIG. 2 is a schematic, perspective illustration, on a larger scale, of a shelf according to the present invention.
Figure 3:
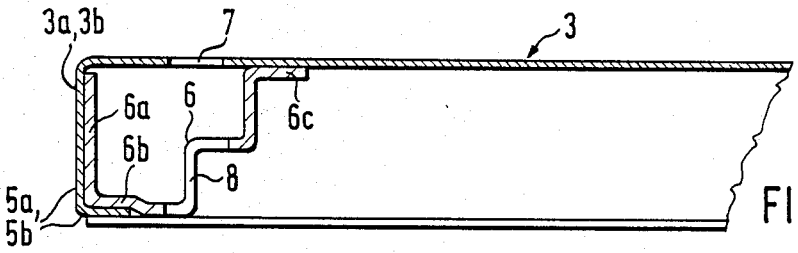
FIG. 3 is a sectional view, on a larger scale, taken along sectional line III—III of FIG. 2.
Figure 4:
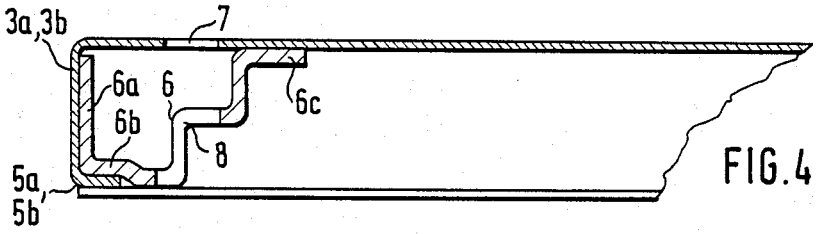
FIGS. 4 to 8 are sectional views, similar to FIG. 3, of further embodiments of the shelf according to the present invention.
Figure 5:
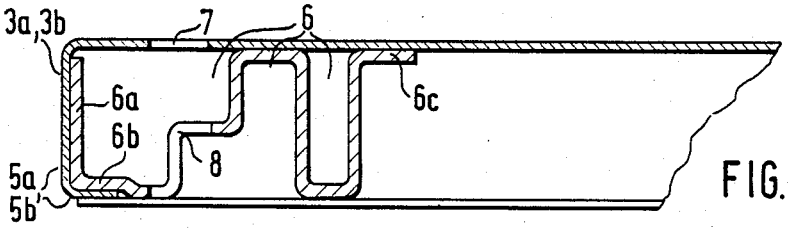
Figure 6:
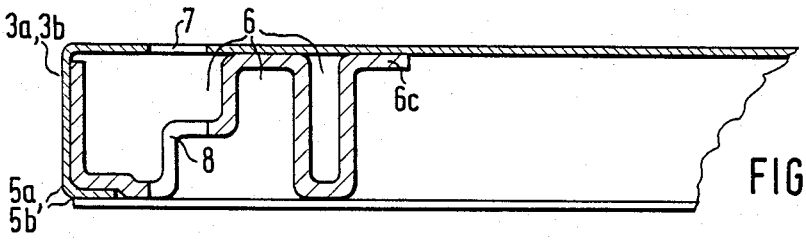
Figure 7:
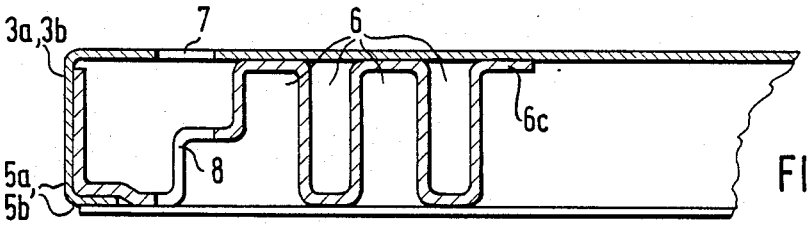
Figure 8:
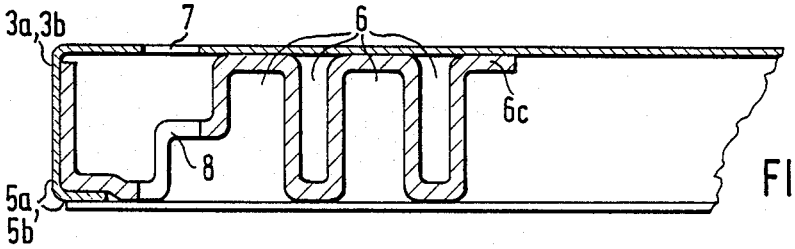

As can be seen in FIG. 2, each shelf 3 has stiffening portions 4*a* and 4*b* at its longitudinals sides 3*a* and 3*b* and similar stiffening portions 4*c* and 4*d* at its transverse sides. While the stiffening portions 4*c* and 4*d* at the transverse sides 3*c l and 3d* of the shelves may merely be approximately L-shaped or angle-shaped bent edges 5*c* and 5*d* of a sheet metal blank, the stiffening portions 4*a* and 4*b* at the longitudinal sides 3*a* and 3*b* may be formed by similar bent edges 5*a* and 5*b* which are supplemented by additional sectional members 6 of laminated material.

As illustrated in FIGS. 3 through 8 of the drawing, the bent edges 5*a* and 5*b* at the longitudinal sides 3*a*, 3*b* of the shelves 3 have cross-sectional profiles which are approximately L-shaped or angle-shaped and are open toward the center of the shelf. In other words, the bent edges 5*a* and 5*b* have the same shape as the bent edges 5*c* and 5*d* formed at the transverse sides 3*c* and 3*d* of the shelf 3.

As can be seen particularly clearly in FIGS. 3 to 8, the additional sectional members 6 have such a cross-sectional shape that they fit at least over a portion thereof in the open profiles of the bent edges 5*a* and 5*b*. In addition, the sectional members 6 are shaped so that they can be attached and fixed to and/or in the bent edges 5*a* and 5*b* and can additionally be connected to the shelf 3.

It is of particular importance that the sectional members 6 may have a material thickness which is different from the thickness of the laminated material of the shelf 3 and of bent edges 5*a* and 5*b*. Usually, the material thickness of the sectional members 6 is greater than that of the shelf 3. Of course, it is possible to make available sectional members 6 having the same cross-sectional shape but having different material thicknesses, as illustrated in FIGS. 3 and 4, FIGS. 5 and 6 and FIGS. 7 and 8, respectively. Consequently, it is possible to assemble shelves 3 with sectional members 6 of different material thicknesses in order to adapt the shelves for different applications requiring different load bearing capacities.

As FIGS. 3 to 8 further show, several sectional members of different cross-sectional shapes may be made available, so that the shelves 3 can be adapted within wide limits with respect to load bearing capacity and stability.

The sectional members 6 of laminated material may be obtained by bending sheet metal sections. However, they may also be rolled sections or extruded sections.

In any event, it is recommended that the cross-sectional areas of the sectional members engaging in the bent edges 5*a* and 5*b* of the shelves 3 have at least two wall portions 6*a* and 6*b* which extend at an angle relative to each other and rest against the inner surfaces of the bent edges 5*a* and 5*b*. Wall portions 6*a* and 6*b* can be attached to bent edges 5*a* and 5*b* by means of spot welding and/or riveting. The sectional member 6 may additionally be provided with support flanges 6*c* which rest against the bottom sides of the shelves 3 and may also be connected to the shelf by means of spot welding or riveting.

As is apparent from the illustrations of FIGS. 3 to 8, the sectional members 6 may have various cross-sectional shapes. Predominantly, stepped and/or creased sectional shapes may be used, i.e., shapes which are open or half-open.

FIGS. 3 to 8 also show that shelves 3 may have openings 7 near the bent edges 5*a* and 5*b*. Openings 8 formed in sectional members 6 can be placed adjacent openings 7*b* in the shelves. The openings 7 and 8 can be then used together as engagement means for support tongues which are used to fix support walls of the shelf system between two shelves 3 mounted spaced apart one above the other.

Figure 9:
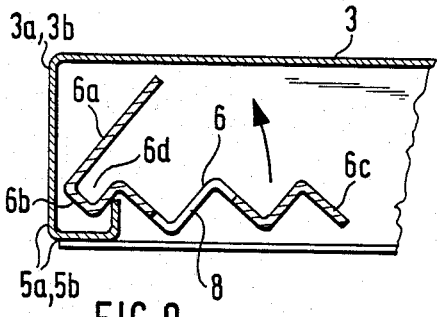
FIGS. 9 to 13 are sectional views, similar to FIG. 3, of additional embodiments of the shelf according to the present invention.
Figure 10:
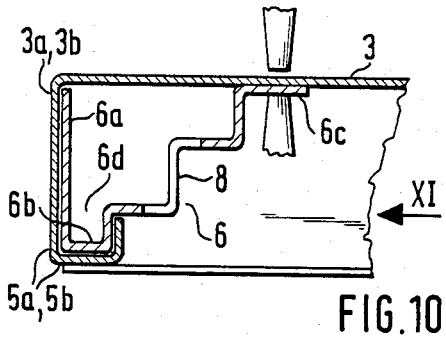
Figure 11:
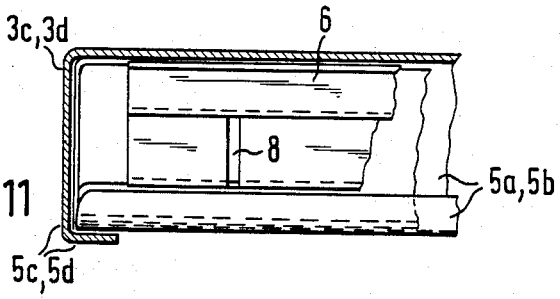

FIGS. 9 to 11 of the drawing show a shelf 3 in which, instead of a L-shaped or angle-shaped cross-section, the stiffening portions 5*a* and 5*b* provided at the longitudinal side of the shelf have an approximately J-shaped cross-section. If the sectional members 6 have corresponding cross-sectional portions, the sectional members 6 can be engaged into this J-shaped portion of the bent edges 5*a* and 5*b* by means of a tilting motion until a positively locking engagement is reached, as can be seen in FIGS. 9 and 10. The sectional members 6 are then finally fixed by means of, for example, spot welding at support flange 6*c* of sectional member 6 which rests against the underside of shelf 3.

The illustration of FIG. 11 shows that the bent portions 5*c* and 5*d* provided at the transverse sides 3*c* and 3*d* of the shelf 3 may have the above-described L-shaped or angle-shaped cross-section, without an additional sections member 6 being inserted into the edges 5*c* and 5*d*.

FIGS. 9 and 10 show that strip-like section portions 6*d* of the sectional members 6 engage in a positively locking manner in the approximately J-shaped bent edges 5*a*, 5*b* at the longitudinal sides 3*a* and 3*b* of the shelf 3. As a result, the section members 6 are adjusted into the correct position in which they are secured by means of a spot welding connection between the support flange 6*d* and the shelf 3.

Figure 12:
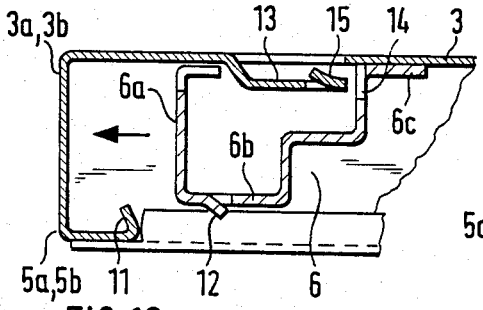
Figure 13:
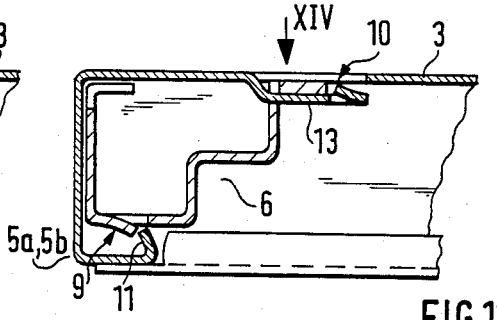
Figure 14:
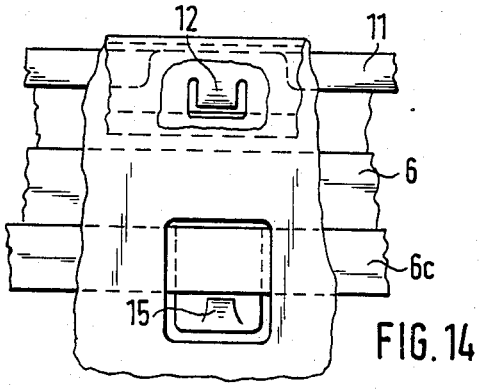
FIG. 14 is partial top view of the embodiment of the shelf of FIG. 13, seen in the direction of arrow XIV.

FIGS. 12 through 14 of the drawing show an embodiment of a shelf 3 and the corresponding sectional member 6 which differs from that illustrated in FIGS. 9 through 11.

In the embodiment shown in FIGS. 12 to 14, the sectional members 6 are fixed by means of special snap connections 9 and 10 in the region of the bent edges 5*a* and 5*b* at the longitudinal sides 3*a* and 3*b*. For this purpose, the edges 5*a* and 5*b* are provided with an end web 11 which is bent at an acute angle and which is engaged in a spring-type connection by tongues 12 formed in sectional member 6 after the sectional member 6 has been moved from the position shown in FIG. 12 in the direction of the horizontally extending arrow shown in FIG. 12 into the position shown in FIG. 13. At the same time, tongues 13 which are punched out of the shelf 3 and are bent downwardly reach engagement with slots 14 which are provided in the sectional member 6 underneath support flange 6*c*. Also, tongues 13 are pushed underneath flange 6*c* and engage the free edge of the latter in a locking manner by means of a spring lug, as clearly illustrated in FIGS. 13 and 14.

The cross-sectional shapes of the sectional members 6 shown in FIGS. 9 and 10 and FIGS. 12 and 13 can be changed to those shown in FIGS. 3 through 8. Also, the thickness of the material of each sectional member 6 can be selected differently in accordance with the specific requirement.

However, it is important in all cases that it is possible to make the shelves 3 proper and the bent edges 5*a* through 5*d* thereof of a material which is thinner than the material used for making the sectional members 6.

While specific embodiments of the invention have been shown and described in detail to illustrate the application of the inventive principles, it will be understood that the invention may be embodied otherwise without departing from such principles.

I claim:

1. In a shelf of laminated material, wherein the shelf has a horizontally extending center portion, an underside and longitudinal and transverse sides, the shelf having bent edges at the longitudinal sides, the bent edges forming stiffening portions which over the width thereof have cross-sectional profiles which are at least partially pen toward the center of the shelf, the shelf having additional sectional members of laminated material, the sectional members having each a cross-sectional shape which fits at least partially into the open cross-sectional profile of the bent edges of the shelf, the additional sectional members being attachable and fixable on or in the bent edges of the shelf, the improvement comprising each bent edge having a vertically extending edge portion and a horizontally extending edge portion adjacent the vertical edge portion, each vertically and horizontally extending edge portion having an inwardly facing inner surface, each sectional member having a vertically extending sectional portion and a horizontally extending sectional portion adjacent the vertical sectional portion, the vertical sectional portion being supported by the inner surface of the vertical edge portion and the horizontal sectional portion being supported by the inner surface of the horizontal edge portion, each sectional member further having immediately adjacent the horizontal sectional portion a sectional end portion formed by a plurality of sectional steps, sectional creases, sectional channels, the sectional end portions extending upwardly to and resting against the side of the center portion.

2. The shelf according to claim 1, wherein the laminated material is sheet metal.

3. The shelf according to claim 1, wherein the thickness of the material of the sectional members is different from the thickness of the material of the shelf.

4. The shelf according to claim 3, wherein the thickness of the material of the sectional members is greater than the thickness of the material of the shelf.

5. The shelf according to claim 1, wherein the sectional members are bent sheet metal sections.

6. The shelf according to claim 1, comprising snap connections for the sectional members.

7. The shelf according to claim 6, wherein the snap connections are locking tongues and lugs formed in one of the sectional members and the shelf and by corresponding engagement openings formed in one of the shelf and the sectional members.

8. The shelf according to claim 1, wherein the sectional members are attached to the shelf center portion in the region of the bent edges by means of welding.

9. The shelf according to claim 1, wherein the sectional members are attached to the shelf center portion in the region of the bent edges by means of riveting.

10. The shelf according to claim 1, wherein the sectional end portion of the sectional members include support flanges and fastening flanges resting against the underside of the center portion.

11. The shelf according to claim 11, wherein the sectional members have different material thicknesses.

12. The shelf according to claim 1, wherein the center portion of the shelf defines openings near the sides thereof, the sectional members defining corresponding openings, wherein the openings of the shelf and the openings of the sectional members can be placed next to each other, so that the openings together form engagement mean adapted for support tongues of separating walls of shelf systems.

13. A method for manufacturing a shelf of laminated material, comprising bending the edges of the shelf downwardly at the sides thereof to form stiffening portions which over the width thereof have cross-sectional profiles which are at least partially open toward the center of the shelf, engaging and connecting additional sectional members of laminated material to the stiffening portions for further increasing the stability of the shelf, wherein the cross-sectional shape and material thickness of the sectional members is selected in accordance with the desired stability of the shelf.

* * * * *